US010829998B2

(12) United States Patent
Peters

(10) Patent No.: US 10,829,998 B2
(45) **Date of Patent: *Nov. 10, 2020**

(54) MODULAR EARTH-BORING TOOLS, MODULES FOR SUCH TOOLS AND RELATED METHODS

(71) Applicant: Baker Hughes, LLC, Houston, TX (US)

(72) Inventor: Volker Peters, Wienhausen (DE)

(73) Assignee: Baker Hughes, a GE company, LLC, Houston, TX (US)

( * ) Notice: Subject to any disclaimer, the term of this patent is extended or adjusted under 35 U.S.C. 154(b) by 37 days.

This patent is subject to a terminal disclaimer.

(21) Appl. No.: 16/242,794

(22) Filed: Jan. 8, 2019

(65) Prior Publication Data

US 2019/0145177 A1 May 16, 2019

Related U.S. Application Data

(63) Continuation of application No. 14/858,063, filed on Sep. 18, 2015, now Pat. No. 10,174,560.
(Continued)

(51) Int. Cl.
*E21B 10/32* (2006.01)
*E21B 17/10* (2006.01)
(Continued)

(52) U.S. Cl.
CPC ..... *E21B 10/322* (2013.01); *E21B 7/068* (2013.01); *E21B 17/1078* (2013.01);
(Continued)

(58) Field of Classification Search
CPC ..... E21B 47/09; E21B 41/00; E21B 17/1078; E21B 44/00; E21B 7/04–10; E21B 33/12; E21B 7/28
See application file for complete search history.

(56) References Cited

U.S. PATENT DOCUMENTS 1,678,075 A 7/1928 Phipps
2,069,482 A 2/1937 Seay
(Continued)

FOREIGN PATENT DOCUMENTS

AU 29733/97 A 1/1998
AU 0710317 B2 9/1999
(Continued)

OTHER PUBLICATIONS

International Written Opinion for International Application No. PCT/US2016/046739 dated Nov. 22, 2016, 9 pages.
(Continued)

*Primary Examiner* — George S Gray
(74) *Attorney, Agent, or Firm* — TraskBritt

(57) ABSTRACT

A self-contained module for actuating an element of an earth-boring tool comprises a drive unit configured to be coupled to at least one actuatable element of the earth-boring tool. The drive unit is configured to be disposed at least partially within a compartment of a body of the earth-boring tool. The compartment is radially decentralized within the earth-boring tool. The drive unit includes a drive element configured to be coupled to the at least one actuatable element. The drive unit is configured to move the drive element in a manner moving the at least one actuatable element from a first position to a second position in a direction having a component parallel with a longitudinal axis of the earth-boring tool. The self-contained module is configured to be repeatedly attached to and detached from the earth-boring tool. Such a module may be attached to a tool body carrying extendable elements to form an earth-boring tool for borehole enlargement or stabilization within an enlarged section of the borehole.

20 Claims, 7 Drawing Sheets

Related U.S. Application Data

(60) Provisional application No. 62/205,491, filed on Aug. 14, 2015.

(51) Int. Cl.
*E21B 41/00* (2006.01)
*E21B 47/00* (2012.01)
*E21B 7/06* (2006.01)
*E21B 47/09* (2012.01)

(52) U.S. Cl.
CPC ..... *E21B 41/00* (2013.01); *E21B 47/09* (2013.01); *E21B 7/06* (2013.01); *E21B 10/325* (2013.01)

(56) References Cited

U.S. PATENT DOCUMENTS 2,136,518 A 11/1938 Nixon
2,177,721 A 10/1939 Johnson et al.
2,344,598 A 3/1944 Church
2,532,418 A 12/1950 Page
2,638,988 A 5/1953 Williams
2,754,089 A 7/1956 Kammerer, Jr.
2,758,819 A 8/1956 Kammerer, Jr.
2,834,578 A 5/1958 Carr
2,874,784 A 2/1959 Baker et al.
2,882,019 A 4/1959 Carr et al.
3,083,765 A 4/1963 Kammerer
3,105,562 A 10/1963 Stone et al.
3,123,162 A 3/1964 Rowley
3,126,065 A 3/1964 Chadderdon
3,171,502 A 3/1965 Kammerer
3,208,540 A 9/1965 Park
3,211,232 A 10/1965 Grimmer
3,224,507 A 12/1965 Cordary et al.
3,283,834 A 11/1966 Kammerer
3,289,760 A 12/1966 Kammerer
3,351,137 A 11/1967 Horst et al.
3,425,500 A 2/1969 Fuchs
3,433,313 A 3/1969 Brown
3,472,533 A 10/1969 Turner
3,556,233 A 1/1971 Gilreath et al.
4,055,226 A 10/1977 Weber
4,231,437 A 11/1980 Swersky et al.
4,366,971 A 1/1983 Lula
4,403,659 A 9/1983 Upchurch
4,458,761 A 7/1984 Van Vreeswyk
4,545,441 A 10/1985 Williamson
4,589,504 A 5/1986 Simpson
4,660,657 A 4/1987 Furse et al.
4,690,229 A 9/1987 Raney
4,693,328 A 9/1987 Furse et al.
4,698,794 A 10/1987 Kruger et al.
4,756,372 A 7/1988 Airey
4,842,083 A 6/1989 Raney
4,848,490 A 7/1989 Anderson
4,854,403 A 8/1989 Ostertag et al.
4,856,828 A 8/1989 Kessler et al.
4,884,477 A 12/1989 Smith et al.
4,889,197 A 12/1989 Boe
4,893,678 A 1/1990 Stokley et al.
4,944,350 A 7/1990 Airey
5,065,825 A 11/1991 Bardin et al.
5,074,356 A 12/1991 Neff
5,129,689 A 7/1992 Newski et al.
5,139,098 A 8/1992 Blake
5,211,241 A 5/1993 Mashaw et al.
5,224,558 A 7/1993 Lee
5,265,684 A 11/1993 Rosenhauch
5,293,945 A 3/1994 Rosenhauch et al.
5,305,833 A 4/1994 Collins
5,318,131 A 6/1994 Baker
5,318,137 A 6/1994 Johnson et al.
5,318,138 A 6/1994 Dewey et al.
5,332,048 A 7/1994 Underwood et al.
5,343,963 A 9/1994 Bouldin et al.
5,361,859 A 11/1994 Tibbitts
5,368,114 A 11/1994 Tandberg et al.
5,375,662 A 12/1994 Echols et al.
5,402,856 A 4/1995 Warren et al.
5,406,983 A 4/1995 Chambers et al.
5,415,243 A 5/1995 Lyon et al.
5,425,423 A 6/1995 Dobson et al.
5,437,308 A 8/1995 Morin et al.
5,443,129 A 8/1995 Bailey et al.
5,553,678 A 9/1996 Barr et al.
5,560,440 A 10/1996 Tibbitts
5,740,864 A 4/1998 De et al.
5,765,653 A 6/1998 Doster et al.
5,788,000 A 8/1998 Maury et al.
5,823,254 A 10/1998 Dobson et al.
5,826,652 A 10/1998 Tapp
5,862,870 A 1/1999 Hutchinson
5,887,655 A 3/1999 Haugen et al.
6,039,131 A 3/2000 Beaton
6,059,051 A 5/2000 Jewkes et al.
6,070,677 A 6/2000 Johnston, Jr.
6,109,354 A 8/2000 Ringgenberg et al.
6,116,336 A 9/2000 Adkins et al.
6,131,675 A 10/2000 Anderson
6,173,795 B1 1/2001 McGarian et al.
6,189,631 B1 2/2001 Sheshtawy
6,213,226 B1 4/2001 Eppink et al.
6,227,312 B1 5/2001 Eppink et al.
6,289,999 B1 9/2001 Dewey et al.
6,325,151 B1 12/2001 Vincent et al.
6,360,831 B1 3/2002 Aakesson et al.
6,378,632 B1 4/2002 Dewey et al.
6,488,104 B1 12/2002 Eppink et al.
6,494,272 B1 12/2002 Eppink et al.
6,615,933 B1 9/2003 Eddison
6,668,936 B2 12/2003 Williamson et al.
6,668,949 B1 12/2003 Rives
6,681,860 B1 1/2004 Yokley et al.
6,702,020 B2 3/2004 Zachman et al.
6,708,785 B1 3/2004 Russell et al.
6,732,817 B2 5/2004 Dewey et al.
7,036,611 B2 5/2006 Radford et al.
7,048,078 B2 5/2006 Dewey et al.
7,252,163 B2 8/2007 Ollerenshaw et al.
7,314,099 B2 1/2008 Dewey et al.
7,513,318 B2 4/2009 Underwood et al.
7,681,666 B2 3/2010 Radford et al.
7,757,787 B2 7/2010 Mackay et al.
7,823,663 B2 11/2010 Eddison
7,900,717 B2 3/2011 Radford et al.
8,020,635 B2 9/2011 Radford
8,074,747 B2 12/2011 Radford et al.
8,118,101 B2 2/2012 Nelson et al.
8,196,679 B2 6/2012 Radford
8,230,951 B2 7/2012 Radford et al.
8,297,381 B2 10/2012 Radford et al.
8,485,282 B2 7/2013 Gentry
8,540,035 B2 9/2013 Xu et al.
8,657,039 B2 2/2014 Radford et al.
8,844,635 B2 9/2014 Oxford
8,881,833 B2 11/2014 Radford et al.
8,936,110 B2 1/2015 Adam
8,986,028 B2 3/2015 Mueller et al.
9,027,650 B2 5/2015 Radford et al.
9,052,043 B2 6/2015 Mueller et al.
9,341,027 B2 5/2016 Radford et al.
9,587,454 B1 * 3/2017 Beard ..... E21B 33/03
10,036,206 B2 7/2018 Radford et al.
2002/0070052 A1 6/2002 Armell et al.
2003/0026167 A1 2/2003 Hahn et al.
2003/0029644 A1 2/2003 Hoffmaster et al.
2004/0222022 A1 11/2004 Nevlud et al.
2005/0145417 A1 7/2005 Radford et al.
2006/0060384 A1 3/2006 Michael
2006/0144623 A1 7/2006 Ollerensaw et al.
2006/0207797 A1 9/2006 Dewey et al.
2007/0089912 A1 4/2007 Eddison et al.

(56) References Cited

U.S. PATENT DOCUMENTS

| | | | | |
|---|---|---|---|---|
| 2008/0093080 | A1 | 4/2008 | Palmer et al. | |
| 2008/0128174 | A1 | 6/2008 | Radford et al. | |
| 2008/0128175 | A1 | 6/2008 | Radford et al. | |
| 2009/0032308 | A1 | 2/2009 | Eddison | |
| 2009/0057015 | A1 | 3/2009 | Treviranus et al. | |
| 2010/0006339 | A1 | 1/2010 | Desai | |
| 2010/0089583 | A1 | 4/2010 | Xu et al. | |
| 2010/0108394 | A1 | 5/2010 | Ollerenshaw et al. | |
| 2010/0139981 | A1 | 6/2010 | Meister et al. | |
| 2010/0193248 | A1 | 8/2010 | Radford et al. | |
| 2010/0224414 | A1 | 9/2010 | Radford et al. | |
| 2011/0005836 | A1 | 1/2011 | Radford et al. | |
| 2011/0031023 | A1* | 2/2011 | Menezes | E21B 7/068 175/61 |
| 2011/0073370 | A1 | 3/2011 | Gentry | |
| 2011/0073376 | A1 | 3/2011 | Radford et al. | |
| 2011/0127044 | A1 | 6/2011 | Radford et al. | |
| 2011/0198096 | A1 | 8/2011 | Mailand et al. | |
| 2011/0232915 | A1 | 9/2011 | Kellner et al. | |
| 2011/0278017 | A1 | 11/2011 | Themig et al. | |
| 2011/0284233 | A1 | 11/2011 | Wu et al. | |
| 2012/0018173 | A1 | 1/2012 | Herberg et al. | |
| 2012/0048571 | A1 | 3/2012 | Radford et al. | |
| 2012/0055714 | A1 | 3/2012 | Adam | |
| 2012/0080183 | A1 | 4/2012 | Radford et al. | |
| 2012/0080231 | A1 | 4/2012 | Radford et al. | |
| 2012/0084051 | A1 | 4/2012 | Hackner et al. | |
| 2012/0111574 | A1 | 5/2012 | Desranleau et al. | |
| 2012/0298422 | A1 | 11/2012 | Oxford | |
| 2013/0168099 | A1 | 7/2013 | Themig | |
| 2013/0206401 | A1 | 8/2013 | Bhoite et al. | |
| 2013/0292175 | A1 | 11/2013 | Radford et al. | |
| 2014/0110178 | A1* | 4/2014 | Savage | E21B 7/062 175/76 |
| 2014/0144537 | A1 | 5/2014 | Peters et al. | |
| 2014/0148029 | A1 | 5/2014 | Mueller et al. | |
| 2014/0176334 | A1 | 6/2014 | Benedict et al. | |
| 2014/0246236 | A1 | 9/2014 | Radford et al. | |
| 2014/0246246 | A1 | 9/2014 | Radford | |
| 2014/0290930 | A1 | 10/2014 | Peters | |
| 2014/0332235 | A1 | 11/2014 | Mueller et al. | |
| 2014/0352941 | A1 | 12/2014 | Mueller et al. | |
| 2015/0027685 | A1 | 1/2015 | Peters et al. | |
| 2015/0041215 | A1 | 2/2015 | Schulz et al. | |
| 2015/0060041 | A1 | 3/2015 | Mueller et al. | |
| 2015/0070185 | A1 | 3/2015 | Schulz et al. | |
| 2015/0322725 | A1* | 11/2015 | Fuller | E21B 7/28 166/373 |
| 2018/0334857 | A1 | 11/2018 | Radford et al. | |

FOREIGN PATENT DOCUMENTS

| | | | |
|---|---|---|---|
| EP | 0246789 | A2 | 11/1987 |
| EP | 0301890 | A2 | 2/1989 |
| EP | 0594420 | A1 | 4/1994 |
| EP | 1036913 | A1 | 9/2000 |
| EP | 1044314 | A1 | 10/2000 |
| GB | 2328964 | A | 3/1999 |
| GB | 2344122 | A | 5/2000 |
| GB | 2344607 | A | 6/2000 |
| GB | 2385344 | A | 8/2003 |
| WO | 97/47849 | A1 | 12/1997 |
| WO | 99/28587 | A1 | 6/1999 |
| WO | 99/28588 | A1 | 6/1999 |
| WO | 00/31371 | A1 | 6/2000 |
| WO | 2004/088091 | A1 | 10/2004 |
| WO | 2009/132462 | A1 | 11/2009 |

OTHER PUBLICATIONS

International Search Report for International Application No. PCT/US2016/046739 dated Nov. 22, 2016, 2 pages.

* cited by examiner

MODULAR EARTH-BORING TOOLS, MODULES FOR SUCH TOOLS AND RELATED METHODS

CROSS-REFERENCE TO RELATED APPLICATIONS

This application is a continuation of U.S. patent application Ser. No. 14/858,063, filed Sep. 18, 2015, now U.S. Pat. No. 10,174,560, issued on Jan. 8, 2019, which claims the benefit of U.S. Provisional Patent Application Ser. No. 62/205,491, filed Aug. 14, 2015, titled "Modular Earth-Boring Tools, Modules for Such Tools and Related Methods," the disclosure of each of which is incorporated herein in its entirety by this reference. The subject matter of this application is related to U.S. patent application Ser. No. 13/784,284, filed Mar. 4, 2013, now U.S. Pat. No. 9,341,027, issued May 17, 2016, and to U.S. patent application Ser. No. 15/154,672, filed May 13, 2016, now U.S. Pat. No. 10,036,206, issued Jul. 31, 2018. The subject matter of this application is also related to U.S. patent application Ser. No. 13/784,307, filed Mar. 4, 2013, now U.S. Pat. No. 9,284,816, issued Mar. 15, 2016, and to U.S. patent application Ser. No. 15/042,623, filed Feb. 12, 2016, now U.S. Pat. No. 10,018,014, issued Jul. 10, 2016.

FIELD

Embodiments of the present disclosure relate generally to embodiments of a module for use in an earth-boring apparatus for use in a subterranean wellbore and, more particularly, to modules each comprising a drive unit for applying a force to an actuatable element of the earth-boring apparatus, the modules being attachable to and detachable from a body of the earth-boring apparatus as self-contained units.

BACKGROUND

Expandable reamers and stabilizers are typically employed for enlarging subterranean boreholes. Conventionally, in drilling oil, gas, and geothermal wells, casing is installed and cemented to prevent wellbore walls from caving into the subterranean borehole while providing requisite shoring for subsequent drilling operation to achieve greater depths. Casing is also conventionally installed to isolate different formations, to prevent cross-flow of formation fluids, and to enable control of formation fluids and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach used to enlarge a subterranean borehole includes using eccentric and bi-center bits. Another conventional approach used to enlarge a subterranean borehole includes employing an extended, so-called, "bottom-hole assembly" (BHA) with a pilot drill bit at the distal end thereof and a reamer assembly some distance above the pilot drill bit. This arrangement permits the use of any conventional rotary drill bit type (e.g., a rock bit or a drag bit), as the pilot bit and the extended nature of the assembly permit greater flexibility when passing through tight spots in the borehole as well as the opportunity to effectively stabilize the pilot drill bit so that the pilot drill bit and the following reamer will traverse the path intended for the borehole. This aspect of an extended bottom-hole assembly (BHA) is particularly significant in directional drilling.

As mentioned above, conventional expandable reamers may be used to enlarge a subterranean borehole and may include blades that are pivotably, hingedly or slidably affixed to a tubular body and actuated by force-transmitting components exposed to high pressure drilling fluid flowing within a fluid channel, such as, for example, a generally axial bore, extending through the reamer tool body. The blades in these reamers are initially retracted to permit the tool to be run through the borehole on a drill string, and, once the tool has passed beyond the end of the casing, the blades are extended so the bore diameter may be increased below the casing. The force for actuating the blades to an extended position is conventionally supplied by manipulation of a drill string to which the expandable reamer is attached, hydraulic pressure of the drilling fluid within the fluid channel of the reamer tool body, or a combination of drill string movement and hydraulic pressure. In hydraulically actuated expandable reamers, the reamer tool body is typically fabricated with features and/or components for converting the hydraulic pressure of the drilling fluid within the fluid channel into an actuating force transmitted to the reamer blades. Such reamer tool bodies require complex designs with numerous moving components, as well as numerous dynamically reciprocating fluid seals to prevent unwanted leakage of drilling fluid within the tool body. Accordingly, assembling, repairing and/or servicing such expandable reamers involves complicated, time-consuming processes that must be performed by highly trained technicians.

BRIEF SUMMARY

In some embodiments, a self-contained module for actuating an element of an earth-boring tool comprises a drive unit configured to be coupled to at least one actuatable element of the earth-boring tool. The drive unit is configured to be disposed at least partially within a compartment of a body of the earth-boring tool. The compartment is radially decentralized within the earth-boring tool. The drive unit includes a drive element configured to be coupled to the at least one actuatable element. The drive unit is configured to move the drive element in a manner moving the at least one actuatable element from a first position to a second position in a direction having a component parallel with a longitudinal axis of the earth-boring tool. The self-contained module is configured to be repeatedly attached to and detached from the earth-boring tool.

In other embodiments, an earth-boring tool comprises a tool body having a fluid channel extending from one end of the tool body to the other end of the tool body. The tool body carries one or more actuatable elements. The earth-boring tool includes at least one self-contained module positioned within a compartment of the tool body. The compartment is radially decentralized within the earth-boring tool. The at least one self-contained module is configured to be attached to and detached from the tool body. The at least one self-contained module comprises a drive unit operatively coupled to at least one of the one or more actuatable elements. The drive unit includes a drive element. The drive unit is configured to move the drive element in a manner moving at least one of the one or more actuatable elements from a first position to a second position in a direction having a component parallel with a longitudinal axis of the earth-boring tool.

In yet other embodiments, a method of assembling an earth-boring tool comprises attaching a self-contained module to the earth-boring tool. The self-contained module is configured to be attached to and detached from the earth-boring tool within a compartment of the earth-boring tool accessible from an outer, lateral side surface of the earth-boring tool. The self-contained module includes a drive unit configured to be operatively coupled to at least one actuatable element of the earth-boring tool. The drive unit includes a drive element. The drive unit is configured to move the drive element in a manner moving the at least one actuatable element from a first position to a second position in a direction having a component parallel with a longitudinal axis of the earth-boring tool.

BRIEF DESCRIPTION OF THE DRAWINGS

While the disclosure concludes with claims particularly pointing out and distinctly claiming specific embodiments, various features and advantages of embodiments of the disclosure may be more readily ascertained from the following description when read in conjunction with the accompanying drawings, in which:

DETAILED DESCRIPTION

The illustrations presented herein are not meant to be actual views of any particular earth-boring tool, reamer, sub or component thereof, but are merely idealized representations employed to describe illustrative embodiments. Thus, the drawings are not necessarily to scale.

The references cited herein, regardless of how characterized, are not admitted as prior art relative to the disclosure of the subject matter claimed herein.

When used herein in reference to a location in the wellbore, the terms "above," "upper," "uphole" and "top" mean and include a relative position toward or more proximate the starting point of the well at the surface along the wellbore trajectory, whereas the terms "below," "lower," "downhole" and "bottom" mean and include a relative position away from or more distal the starting point of the well at the surface along the wellbore trajectory.

As used herein, the term "longitudinal" refers to a direction parallel to a longitudinal axis of a downhole tool.

As used herein, the term "transverse" refers to a direction orthogonal to the longitudinal axis of the downhole tool.

As used herein, the term "self-contained module" or "self-contained unit" refers to an independent module or unit that can be coupled to a tool body as a single module or unit and uncoupled from a tool body as a single module or unit. Moreover, as used herein, the term "self-contained module" or "self-contained unit" refers to a module or unit that can be removed from the downhole tool and can be repaired, tested, evaluated, verified, or replaced while removed from the downhole tool.

For conventional reamers and stabilizers in particular, but also for other earth-boring tools such as steering tools, packers, tools comprising actuatable elements such as valves, pistons, or pads, the assembly and disassembly of the tools (such as during routine maintenance, for example) requires significant time and effort in many cases. For instance, if a prior art reamer requires repair, the bottom-hole assembly often needs to be disassembled to isolate the reamer from the bottom-hole assembly. Subsequently, the reamer tool itself may need to be completely disassembled to access the inner components thereof, which may have been subject to wear and may need to be repaired or proactively maintained. The disassembly of the bottom-hole assembly and the tool is often significantly cost intensive for such routine repair and maintenance efforts. It is of high interest for the industry to provide downhole tools comprising actuatable elements comprising self-contained actuation modules that are easily accessible from a lateral side of the tool in order to remove, replace, repair, test, and/or evaluate the modules without the necessity to disassemble the bottom-hole assembly or the remainder of the tool. The current disclosure provides such methods and apparatuses.

Figure 1:
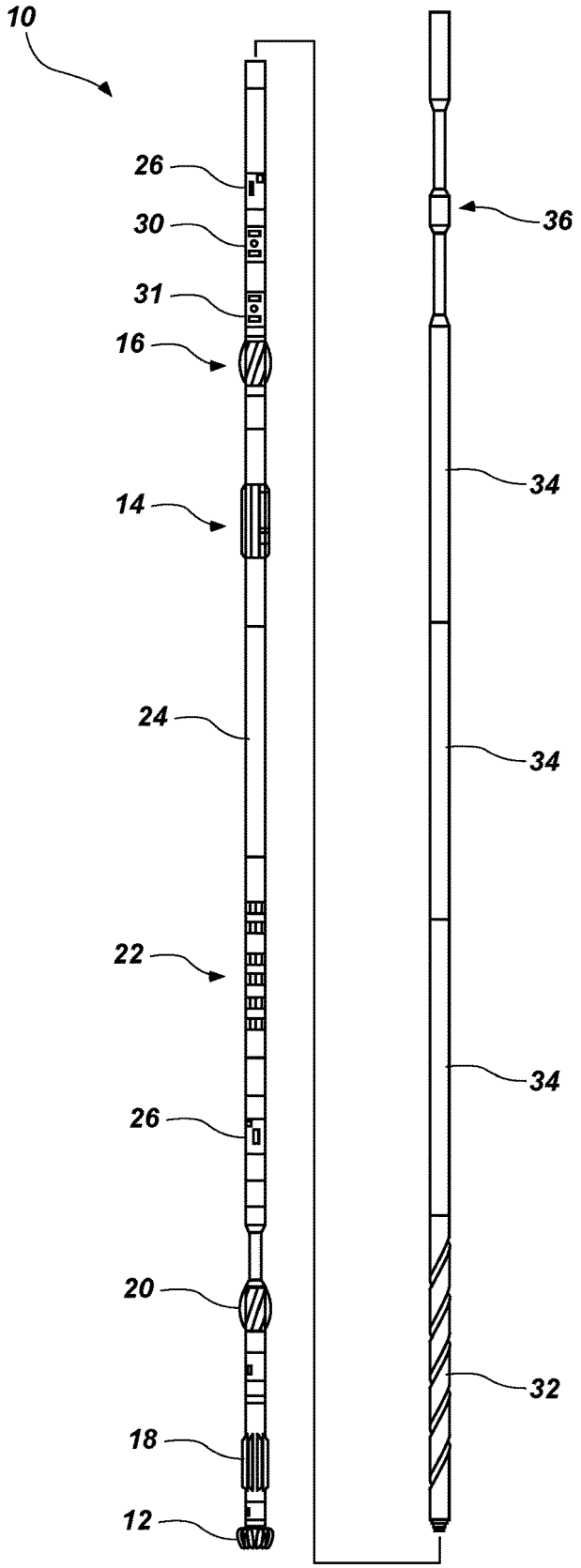
FIG. 1 is a schematic illustration of a bottom-hole assembly (BHA) including a drilling assembly that comprises an expandable reamer.

Referring now to FIG. 1, a downhole assembly is illustrated. The downhole assembly may comprise a bottom-hole assembly (BHA) 10 including components used for reaming a wellbore to a larger diameter than that initially drilled, for concurrently drilling and reaming a wellbore, or for drilling a wellbore. The bottom-hole assembly 10, as illustrated, may include a pilot drill bit 12, an expandable reamer 14 and an expandable stabilizer 16 and, therefore, is suitable for concurrently drilling and reaming a wellbore. The bottom-hole assembly 10 may, optionally, include various other types of drilling tools such as, for example, a steering unit 18, one or more additional stabilizers 20, a measurement while drilling (MWD) tool 22, one or more communication tools 24 (for example, a so-called BCPM (as shown), a siren-type mud pulser, an electro-magnetic telemetry tool, an acoustic telemetry tool or any other tool or combination of tools known in the art), one or more mechanics and dynamics tools 26, one or more electronic devices, which may include, for example, additional measurement devices or sensors 30, such as sonic calipers and RPM recognition devices. The bottom-hole assembly 10 may also include a BHA master controller 31 configured to control selective operation of components of the bottom-hole assembly 10, such as the expandable reamer 14 and the expandable stabilizer 16, as discussed in more detail below. The BHA master controller 31 may optionally be electrically coupled to at least one communication tool 24 for communication with an operator at the well surface. The bottom-hole assembly 10 may additionally include one or more drill collars 32, one or more segments of electrically communicative drill pipe 34, and one or more heavy weight drill pipe (HWDP) segments 36. The BHA master controller 31 may communicate with sensors, actuators, further controllers and/or operators at the well surface in a variety of ways, including direct-line electronic communication and command pattern signals, as discussed in more detail below.

Figure 2:
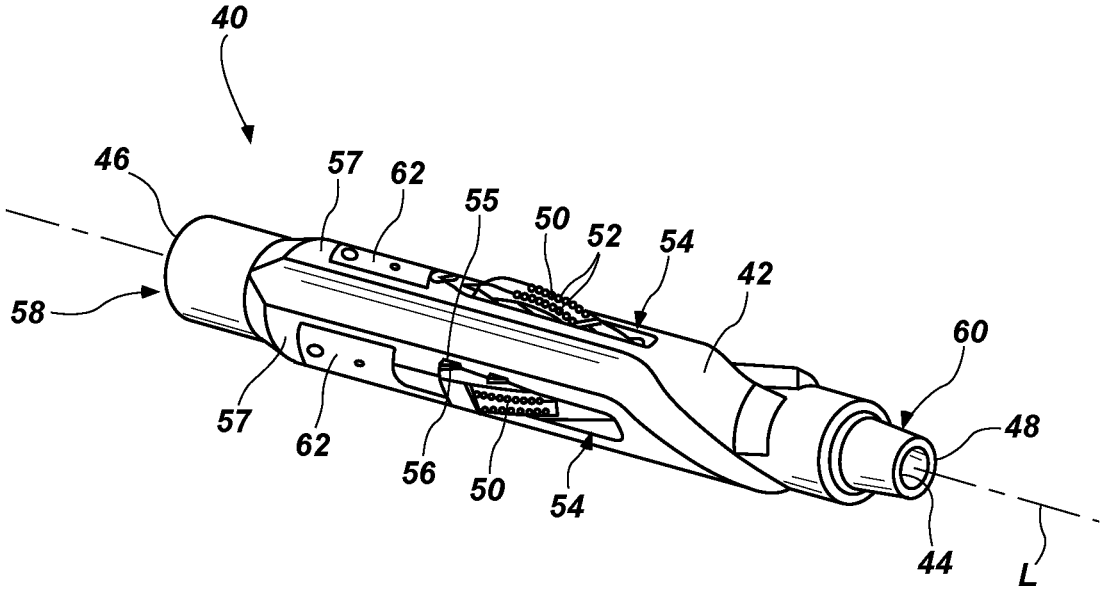
FIG. 2 is a perspective view of an expandable reamer carrying extendable and retractable blades, according to an embodiment of the present disclosure.

FIG. 2 illustrates an earth-boring tool 40 for use in a bottom-hole assembly, such as the expandable reamer 14 in the bottom-hole assembly 10 shown in FIG. 1, for expanding the diameter of a wellbore, or the expandable stabilizer 16 shown in FIG. 1, for, among other things, maintaining BHA stability in the wellbore. The tool 40 may include a tool body 42 having a fluid channel, such as bore 44, extending therethrough from an upper end 46 of the tool body 42 to a lower end 48 of the tool body 42. The bore 44 may be configured for conveying pressurized drilling fluid through the tool body 42 and subsequently to the bit 12 (FIG. 1) located downhole of the tool 40. Accordingly, the tool body 42 may be termed a "tubular" body. It is to be appreciated that the bore 44 may be generally co-extensive with a longitudinal axis L of the tool body 42 or, in other embodiments, may be offset from the longitudinal axis L of the tool body 42. It is also to be appreciated that the bore 44 may have variable cross-sectional areas, cavities, recesses and bifurcations, by way of non-limiting example. With continued reference to FIG. 2, the tool body 42 may house one or more extendable elements configured for performing a specific function on the wellbore. For example, as shown in FIG. 2, the extendable elements may comprise reamer blades 50 carrying cutting elements 52 for engaging and removing subterranean formation material from a sidewall of the wellbore as drilled by a bit 12 of the same bottom-hole assembly, or as previously drilled; however, in other embodiments, other extendable elements may be utilized, such as stabilizer bearing pads, by way of non-limiting example.

The tool 40 is shown having three blades 50 (two of which are visible in FIG. 2) located in circumferentially spaced, longitudinally extending recesses 54 in the tool body 42. It is to be appreciated that one, two, three, four, five or more than five blades 50 may be affixed to the tool body 42 within corresponding recesses 54. Moreover, while the blades 50 may be symmetrically circumferentially positioned along the tool body 42, as shown in the embodiment of FIG. 2, the blades 50 may also be positioned circumferentially asymmetrically around the tool body 42. Additionally, the blades 50 may be positioned at the same longitudinal position along the tool body 42 or at different, partially or completely offset longitudinal positions.

Figure 3:
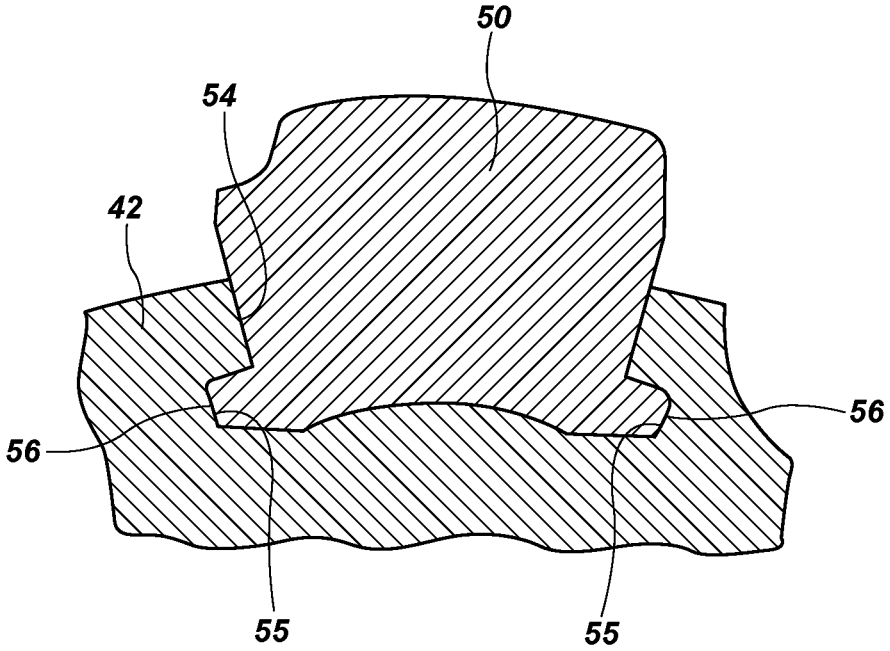
FIG. 3 illustrates a partial cross-sectional view of a portion of a tool body of the expandable reamer of FIG. 2 carrying an extendable and retractable reamer blade having rails located within corresponding slots in a sidewall of a recess in the tool body, according to an embodiment of the present disclosure.

The blades 50 may comprise side rails 56 that ride within corresponding slots 55 in the sidewalls of the recesses 54 of the tool body 42, as shown more clearly in FIG. 3. Referring to FIG. 2, the side rails 56 and slots 55 may be oriented at an acute angle relative to the longitudinal axis L of the tool body 42. The side rails 56 of the blades 50 may slide within the slots 55, causing blades 50 to translate in a combined longitudinal and radially outward direction responsive to an actuation force such that an outer surface of each of the blades 50 may extend radially outward of an outer surface 57 of the tool body 42, as described in U.S. Pat. No. 8,881,833, issued Nov. 11, 2014 to Radford et al.; U.S. Pat. No. 8,230,951, issued Jul. 31, 2012 to Radford et al.; and U.S. Pat. No. 7,900,717, issued Mar. 8, 2011 to Radford et al., the entire disclosure of each of which is incorporated herein by this reference. However, it is to be appreciated that other mechanisms for guiding the blades 50 from a retracted position to extend radially outward beyond the outer surface 57 of the tool body 42 are also within the scope of the present disclosure. For example, the tool body 42 and the blades 50 may be configured as described in any of U.S. Pat. No. 8,020,635, issued Sep. 20, 2011 to Radford; U.S. Pat. No. 7,681,666, issued Mar. 23, 2010 to Radford et al.; and U.S. Pat. No. 7,036,611, issued May 2, 2006 to Radford et al. Additionally, the translation of the blades 50 need not be limited to a combined longitudinal and radially outward direction but may comprise movement in any one or more of a longitudinal, a radial, and an angular direction, including a pure longitudinal, radial, or angular direction. Moreover, while FIGS. 2 and 3 show side rails 56 sliding in slots 55 to guide the blade 50 from a radially inward position to a radially outward position, any combination of features for guiding the blades 50 from a radially inward position to a radially outward position is within the scope of the present disclosure, including, by way of non-limiting example, recesses, steps and rails.

With continued reference to FIG. 2, the upper end 46 of the tool body 42 may include a threaded female box connector 58 for connection to a threaded male connector of an uphole component of the bottom-hole assembly 10 or drill string, and the lower end 48 of the tool body 42 may include a threaded male pin connector 60 for connection to a threaded female connector of a downhole component of the bottom-hole assembly 10 or drill string. However, in other embodiments, the tool body 42 may have a threaded male pin connector at the upper end 46 and a threaded female box connector at the lower end 48, or may have threaded male pin connectors at each of the upper and lower ends 46, 48, or may have threaded female box connectors at each of the upper and lower ends 46, 48.

The tool body 42 may house one or more self-contained actuation modules 62 according to embodiments of the disclosure, each module carrying components for extending and/or retracting one or more of the blades 50 of the tool 40. The actuation modules 62 may each be accessible from the outer surface 57 of the tool body 42 and may be readily attachable to and detachable from the tool body 42 for assembly, servicing or replacement without damaging or disassembling the tool body 42 (or parts thereof) or removing the blades 50, as described in more detail below.

Figure 4:
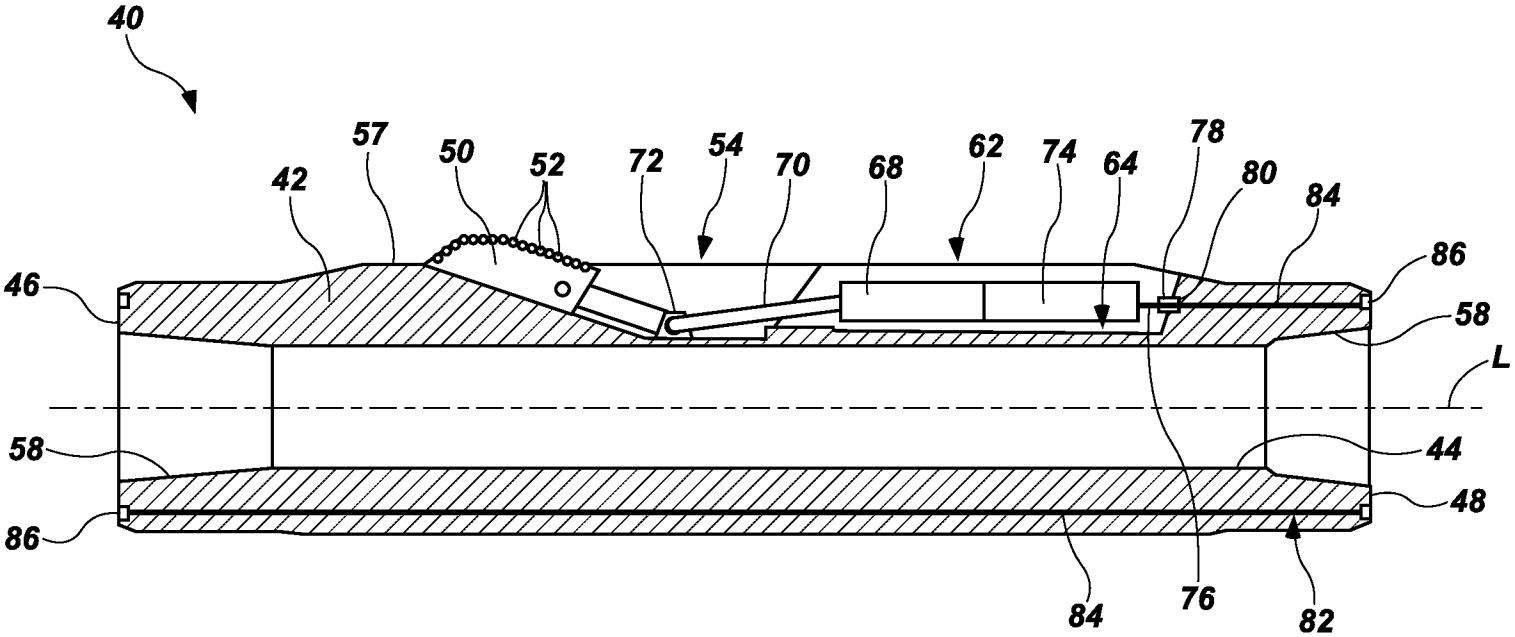
FIG. 4 is a longitudinal, schematic, partial cross-sectional view of an expandable reamer carrying actuation modules positioned longitudinally below reamer blades (one module and one blade shown), according to an embodiment of the present disclosure.

FIG. 4 shows a cross-sectional view of an embodiment of an earth-boring tool 40 comprising the tool body 42 shown in FIG. 2. In the embodiment of FIG. 4, the actuation modules 62 may be located longitudinally below the blades 50 and the tool body 42 may have a threaded female box connector 58 at the lower end 48 (i.e., a "box down" configuration). As shown, the actuation modules 62 may be circumferentially aligned with the corresponding blades 50 and associated side rails 56 and slots 55 within recesses 54; however, in other embodiments, the actuation modules 62 may be circumferentially offset from the blades 50. In embodiments where the tool body 42 includes three blades 50 and three actuation modules 62 positioned symmetrically circumferentially (i.e., separated by 120 degrees) about the longitudinal axis L of the tool body 42, such as shown in FIG. 4, only one blade 50 in corresponding recess 54 and only one actuation module 62 is visible in the cross-sectional view provided. The tool body 42 may be configured such that no portion of any of the actuation modules 62, the blades 50, or any other tool component (other than the tool body 42 itself) extends within or is in direct fluid communication with the bore 44 of the tool body 42, allowing the wall of the bore 44 to be smooth, continuous and uninterrupted from substantially the upper end 46 to the lower end 48 of the tool body 42.

Each actuation module 62 may be located within a corresponding, longitudinally extending module compartment 64 in the tool body 42 and each module 62 may include components for actuation of the blades 50 carried by the tool body 42. The module compartments 64 may be decentralized within the tool body 42, such as at a location radially outward of the bore 44, by way of non-limiting example. A drive unit 68 of each actuation module 62 may include a rod 70 coupled to a yoke structure 72 carried by the tool body 42. The yoke structure 72 may be slidably disposed within the tool body 42, coupled to each of the blades 50 and may transmit to each of the blades 50 substantially longitudinal actuation forces applied by each drive unit 68 of the actuation modules 62. Each actuation module 62 may also include an electronics unit 74 configured to control operation of the associated drive unit 68 of the module 62 for extending and/or retracting the blades 50, as described in more detail below.

In some embodiments (not shown), the yoke structure 72 may be omitted. In such embodiments, one or more drive components of each actuation module 62 may directly engage an associated blade 50 (or a component attached to the associated blade 50). For example, each drive rod 70 (or other drive component of an actuation module 62) may be coupled to a component having a tapered surface configured to engage a mating tapered surface of an associated blade 50 in a manner such that a generally longitudinal actuating motion of the each drive rod 70 moves the associated blades 50 generally radially between the retracted position and the extended position. The mating tapered surfaces of the blades 50 and the components coupled to the drive rods 70 may be tapered in a manner such that the radial movement of the blades 50 is greater than the longitudinal movement of the drive rods 70. Such embodiments may enhance utilization of the accessible longitudinal space in the tool body 42. Additionally, by moving the drive component primarily in the longitudinal direction, actuation forces thereof may be reduced, allowing an easier design and reducing wear on the components of the actuation module 62. It is to be appreciated that the foregoing tapered mating surfaces may be incorporated on the yoke structure 72 and on ends of the drive rods 70 to similar effect, and is within the scope of the present disclosure.

With continued reference to FIG. 4, each electronics unit 74 may include one or more electrical lines or wires 76 extending from an electrical connection terminal 78 of the actuation module 62. The electrical connection terminal 78 of the actuation module 62 may be coupled to a corresponding electrical connection terminal 80 of a power and communication tool bus 82 of the tool body 42. The power and communication tool bus 82 may include one or more electrical lines or wires 84 carried by and extending the length of the tool body 42 for transmitting power and/or command signals to at least one of the actuation modules 62. The wires 84 may be located on an outer surface or inner surface of the tool body 42, or may reside within one or more bores of the body material of the tool body 42.

Figure 5:
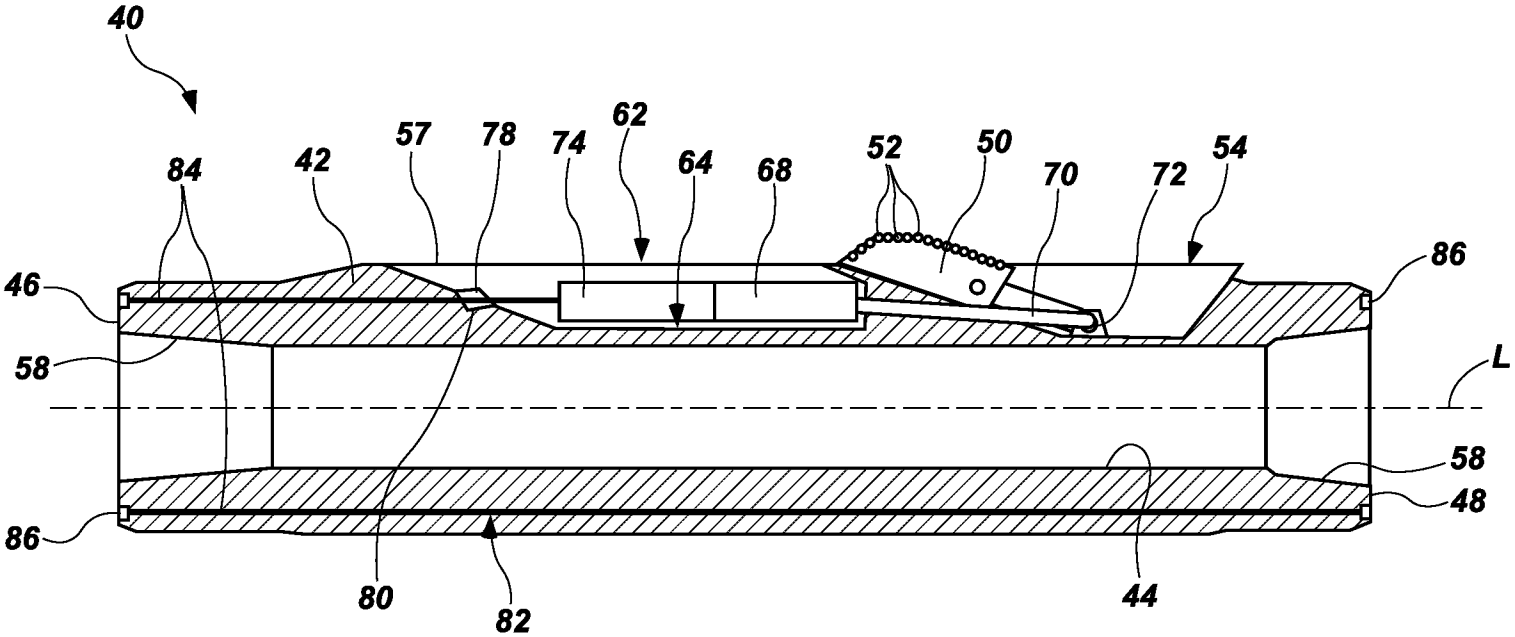
FIG. 5 is a schematic, partial longitudinal cross-sectional view of an expandable reamer carrying actuation modules (one module and one blade shown) positioned longitudinally above the reamer blades, according to an embodiment of the present disclosure.
Figure 6:
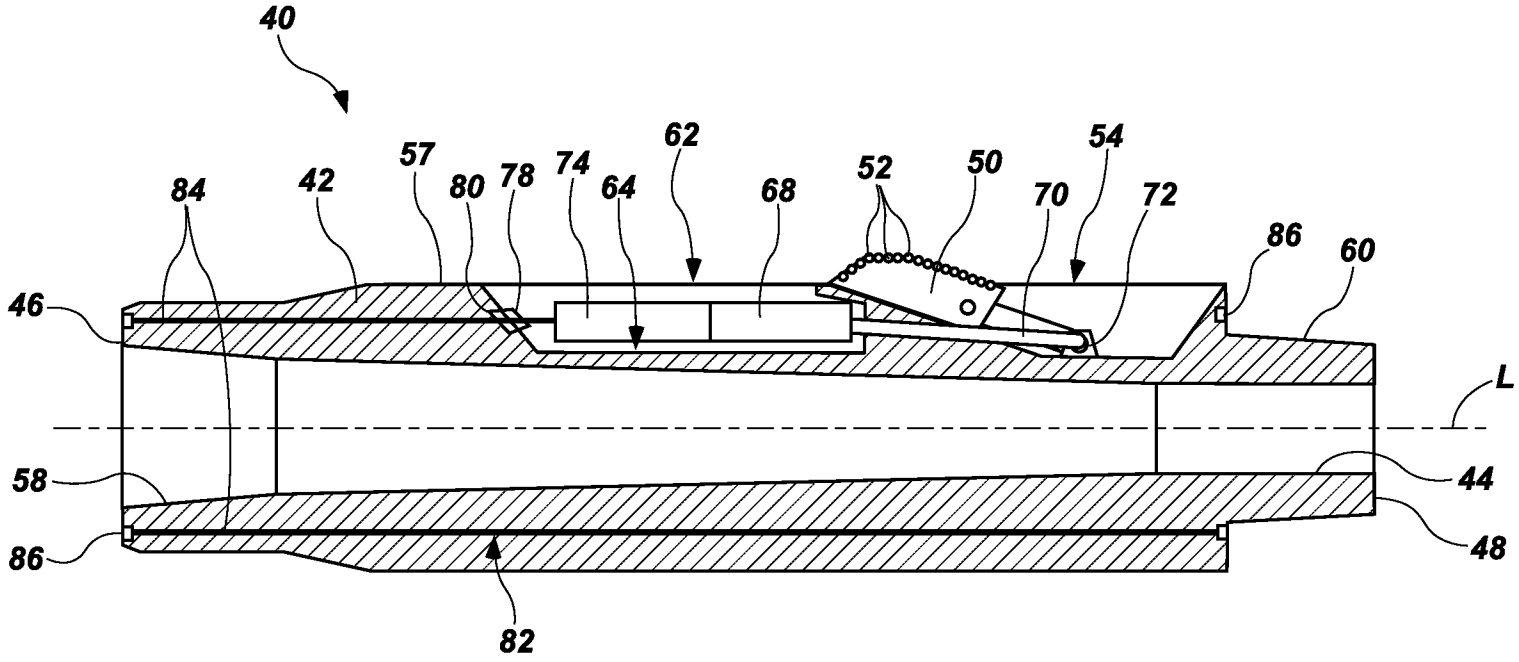
FIG. 6 is a schematic, partial longitudinal cross-sectional view of an expandable reamer carrying actuation modules (one module and one blade shown) and having a "pin down" connection at the lower end of the reamer, according to an embodiment of the present disclosure.

FIG. 5 illustrates an embodiment of the tool body 42 with each actuation module 62, including the accompanying drive unit 68 and electronics unit 74, positioned longitudinally above the blades 50. As with FIG. 4, the tool body 42 in FIG. 5 has a box down connection at the lower end 48 thereof. FIG. 6 illustrates an embodiment of the tool body 42 with each actuation module 62, including the accompanying drive unit 68 and electronics unit 74, positioned longitudinally above the blades 50 and the tool body 42 having a threaded male pin connector 60 at the lower end 48 thereof (i.e., a "pin down" configuration).

As shown in each of FIGS. 4 through 6, the connection threads at the upper and lower ends 46, 48 of the tool body 42 may be configured with a communication element 86 in communication with the one or more wires 84 of the power and communication tool bus 82 extending the length of the tool body 42. The communication element 86 may comprise, by way of non-limiting example, a pad or ring configured to create an electrical, inductive, capacitive, galvanic or electromagnetic coupling (or a coupling by any combination thereof) with a corresponding communication element disposed in the threads of a mating portion of an electrically communicative component, such as a segment of electrically communicative drill pipe 34, or other components of the bottom-hole assembly 10 shown in FIG. 1. In this manner, the tool body 42 may be electrically coupled to a downhole control device, such as the BHA master controller 31 shown in FIG. 1, which in turn may be electrically coupled to a component of the bottom-hole assembly 10, such as one or more of the communication tools 24 shown in FIG. 1, configured to communicate with an operator at the surface of the wellbore. Thus, some or all of the components of the bottom-hole assembly 10 may be in electronic communication with the well surface or with other sections of the drill string, with the tool body 42 comprising a link in the sequence of electrically communicative components of the bottom-hole assembly 10. In other embodiments, a separate controller (not shown) may be located in the tool body 42 and may include a receiver for receiving communications from an operator at the well surface, providing the tool body 42 with "stand-alone" operation of the reamer blades 50 independent of the BHA master controller 31. In such embodiments, the tool body 42 may also house a power module, such as, but not limited to, a battery or a turbine, to provide power to at least one of the separate controller, the receiver, the electronic unit 74 and the actuation module 62.

With continued reference to the embodiments of FIGS. 4 through 6, the power and communication tool bus 82 may be configured for mono- or bi-directional communication between the BHA master controller 31 (FIG. 1) and the actuation modules 62. By way of non-limiting example, in some embodiments, the wires 84 of the power and communication tool bus 82 may comprise a DC voltage line, an AC voltage line, or a combination thereof. In some embodiments, the wires 84 may be configured to transmit DC power and a frequency modulated communication signal from the BHA master controller 31 to the electronics unit 74 of at least one of the actuation modules 62. The wires 84 of the power and communication tool bus 82 may utilize a drill collar as a return line (to ground) or a secondary return wire or a combination of both. It is to be appreciated that, in other embodiments, the wires 84 of the power and communication tool bus 82 may be configured to transmit other power and signal types to each electronics unit 74 of the actuation modules 62.

Figure 7:
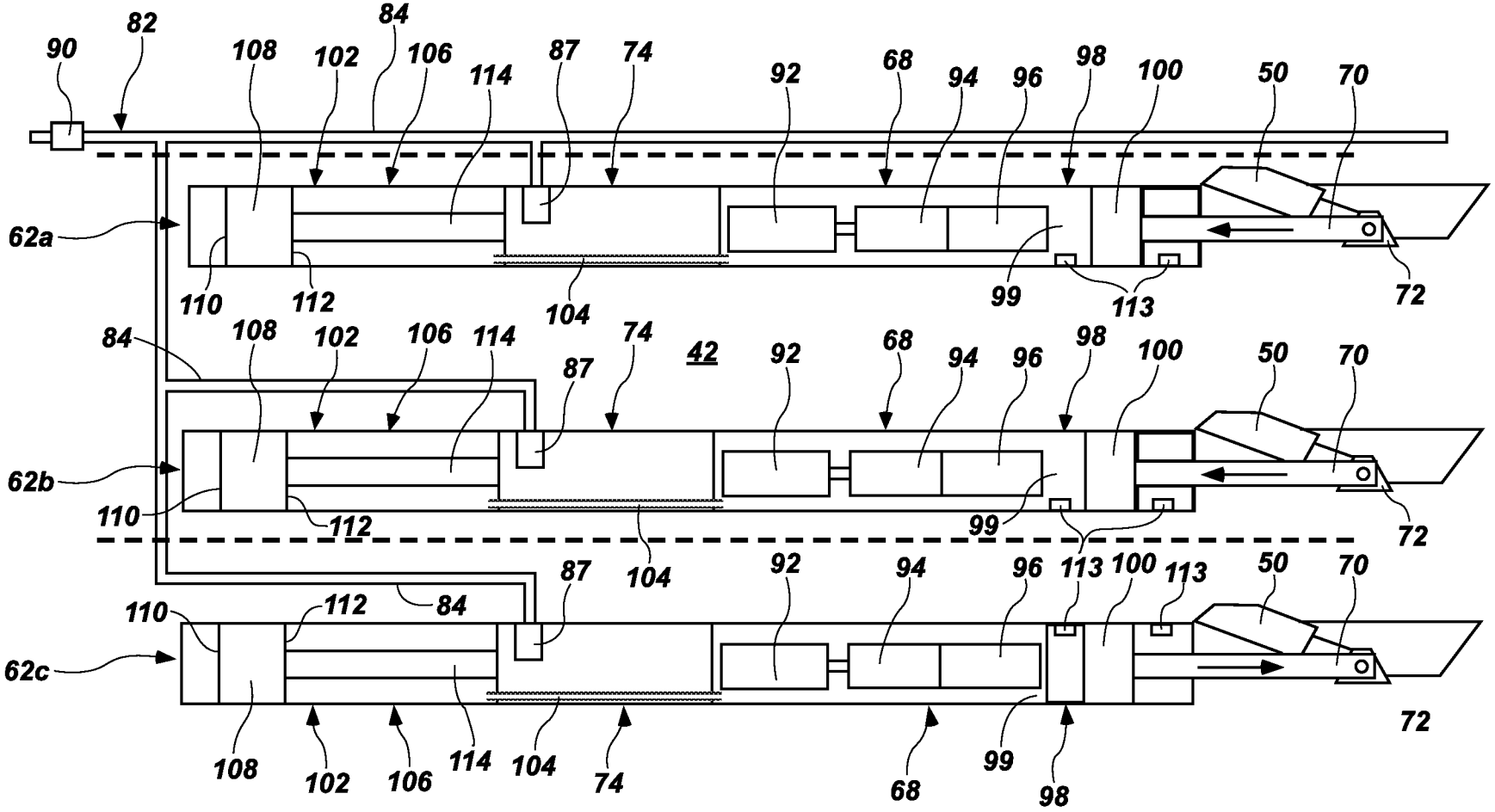
FIG. 7 is a schematic diagram of a plurality of actuation modules of an expandable reamer with associated reamer blades, according to an embodiment of the present disclosure.

Referring now to FIG. 7, a schematic diagram depicts an exemplary, representative arrangement of the power and/or communication tool bus 82 and three actuation modules 62. In particular, the three actuation modules 62 may include a first actuation module 62*a*, a second actuation module 62*b* and a third actuation module 62*c*, each of which may be located in the tool body 42 longitudinally above the blades 50 and may each be coupled to the common yoke structure 72, as previously described. In the particular embodiment shown, the first and second actuation module 62*a*, 62*b* may each be configured to extend the blades 50 by exerting a pulling force on the yoke structure 72, while the third actuation module 62*c* may be configured to retract the blades 50 by exerting a pushing force on the yoke structure 72. Thus, in the embodiment shown in FIG. 7, the first and second actuation modules 62*a*, 62*b* may be termed "extension modules" and the third actuation module 62*c* may be termed a "retraction module." It is to be appreciated that one or more of the actuation modules 62*a*, 62*b*, 62*c* may be configured to both extend and retract the blades 50, depending on the configuration of the actuation modules 62*a*, 62*b*, 62*c* and/or the communication signal from the BHA master controller 31. It may also be the case that only one of the extension modules 62*a*, 62*b* may be necessary to extend the blades 50 through the coupling with the yoke structure 72, while the other actuation module may provide redundancy to the actuation system in the event a failure occurs with one of the extension modules 62*a*, 62*b*.

Furthermore, as previously described, in other embodiments, the actuation modules 62*a*, 62*b*, 62*c* may be located longitudinally below the blades 50 and/or circumferentially offset of the blades and may be configured to extend the blades 50 by exerting a pushing force with a force component parallel to the longitudinal axis L on the yoke structure 72 or with the previously described tapered mating surfaces (not shown) and to retract the blades 50 by exerting a pulling force with a force component parallel to the longitudinal axis L on the yoke structure 72 or with the tapered mating surfaces.

In further embodiments (not shown), one of the three actuation modules 62*a*, 62*b*, 62*c* may be configured to extend the blades 50 while the other two of the three actuation modules 62*a*, 62*b*, 62*c* may be configured to subsequently retract the blades 50. In yet other embodiments, one or more of the actuation modules 62*a*, 62*b*, 62*c* may be configured to selectively exert both a pushing force and a pulling force on the yoke structure 72 to extend and retract the blades 50, respectively.

As previously described, the power and communication tool bus 82 may include wires 84 extending to the electronics unit 74 of each of the actuation modules 62*a*, 62*b*, 62*c*. Each electronics unit 74 may include a modem 87 for transmitting data between the respective electronics unit 74 and the power and communication tool bus 82. In this manner, the power and communication tool bus 82 may communicate individually with each electronics unit 74 of the associated actuation modules 62*a*, 62*b*, and 62*c*.

The power and communication tool bus 82 may convey to each electronics unit 74 a command signal, received from the BHA master controller 31 (FIG. 1), and power for controlling and operating the associated drive unit 68. The command signal may be a frequency modulated signal, although other signal types, such as an amplitude modulated signal, are within the scope of the present disclosure. The power and the frequency modulated signal transmitted by the power and communication tool bus 82 to each electronics unit 74 may be used to control the drive force applied by the associated drive unit 68 to the blades 50, as well as the degree of extension of the blades 50. In this manner, the blades 50 may be extended to a particular radial position responsive to a particular signal received from the BHA master controller 31. The command signals transmitted from the BHA master controller 31 to the electronics units 74 of the modules 62 may, in turn, be selected by an operator in a drilling rig at the well surface utilizing one or more of various types of communication between the well surface and the BHA master controller 31.

In some embodiments, an operator at the well surface may communicate with the BHA master controller through mud pulse telemetry. In such embodiments, the operator may control the extension of the blades 50 of the tool body 42 by initiating a sequence of pulses of hydraulic pressure in the drilling fluid, or "mud pulses," as known in the art, of a varying parameter, such as duration, amplitude and/or frequency, which pulses may be detected by a downhole pressure sensor (not shown). The pressure sensor may be located in a communication tool 24 positioned in the bottom-hole assembly 10 (shown in FIG. 1). The communication tool 24 may be in electrical communication with the BHA master controller 31 through electrically communicative drill pipe or other electronic communication means. The communication tool 24 may comprise a processor (not shown), which may transform the detected mud pulse pattern into an electronic data signal and transmit the electronic data signal to the BHA master controller 31. The BHA master controller 31 may interpret the electronic data signal and transmit a corresponding command signal to the electronics unit 74 of each actuation module 62 through the power and communication tool bus 82. The BHA master controller 31 may include a processor (not shown) that decodes the electronic data signal received from the communication tool 24 by comparing the data signal to patterns stored in processor memory corresponding to predetermined positions of the blades 50 in relation to the tool body 42. When the BHA master controller 31 identifies a stored pattern corresponding to the pattern communicated in the data signal from the communication tool 24, the BHA master controller 31 may transmit a command signal to the electronics units 74 of the actuation modules 62, which, in turn, may operate the associated drive units 68 to move the blades 50 to the corresponding predetermined position. In other embodiments, the BHA master controller 31 may communicate with an operator at the well surface wirelessly, directly through electrically communicative drill pipe, or using any other communication method. In further embodiments, the command signal may be sent as variations of the flow pattern, which variations may be detected by a flow sensing element, such as a turbine in the bottom-hole assembly, and further processed by the communication tool 24 or BHA master controller 31.

With continued reference to FIG. 7, the drive units 68 of the actuation modules 62 may each include a hydraulic system comprising an electric motor 92 operatively coupled to a hydraulic pump 94 and optionally an electronically controlled valve assembly 96 in fluid communication with a drive vessel 98. The drive vessel 98 may be a cylinder or any other type of vessel in communication with hydraulic fluid. The drive vessel 98 may be in fluid communication with a reservoir 99 containing hydraulic fluid, although other pressure mediums may be utilized in other embodiments. A drive element such as a drive piston 100 may be disposed in the drive vessel 98 and may be coupled to the rod 70, which is coupled to the yoke structure 72, which, in turn, is coupled to the blades 50, as previously described. The electric motor 92 may operate at a speed and torque responsive to the power and the command signal transmitted from the BHA master controller 31 through the power and communication tool bus 82, which may drive the pump 94 in a manner to adjust the pressure within the drive vessel 98 on a particular side of the drive piston 100 to cause the drive piston 100 to move a predetermined distance in a predetermined direction and to exert a predetermined force on the blades 50 through the rod 70 and the yoke structure 72.

The electronically controlled valve assembly 96 of each drive unit 68 may control the conveyance of hydraulic fluid pressurized by the pump 94 to various portions of the drive vessel 98 on opposing sides of the drive piston 100 during a drive stroke and a return stroke of the associated drive piston 100. For example, in the embodiment shown in FIG. 7, wherein the drive pistons 100 extend the blades 50 by pulling the yoke structure 72, the valve assemblies 96 of the drive units 68 of the extension modules 62*a*, 62*b* may be switched to positions to convey, during a drive stroke, pressurized hydraulic fluid to the portion of the drive vessel 98 located on a first side, or "rod side," of the drive piston 100 to cause the drive piston 100 to move in a direction axially opposite the yoke structure 72, thus pulling the yoke structure 72 toward the upper end of the tool body 42 and extending the blades 50. Concurrently, during the drive stroke, the valve assemblies 96 of the extension modules 62*a*, 62*b* may be switched to positions to allow hydraulic fluid to pass from the portion of the drive vessel 98 on the opposite, "free side," of the drive piston 100 to the reservoir 99. To retract the blades 50, the valve assembly 96 of the drive unit 68 of the retraction module 62*c* may be switched to a position to convey hydraulic fluid pressurized by the associated pump 94 to the portion of the drive vessel 98 on the free side of the drive piston 100 to cause the drive piston 100 to move in a direction axially toward the yoke structure 72, thus pushing the yoke structure 72 toward to the lower end of the tool body 42 and retracting the blades 50. Concurrently, the valve assembly 96 of retraction module 62*c* may permit hydraulic fluid to bleed from the rod side of the drive piston 100 into the reservoir 99. Also concurrently, during the return stroke, the valve assemblies 96 of the extension modules 62*a*, 62*b* may, optionally, be switched to positions to convey pressurized hydraulic fluid from the portion of the drive vessel 98 on the rod side of the drive piston 100 to the portion of the drive vessel 98 on the free side of the drive piston 100, to the reservoir 99, or to both. In embodiments where one or more of the actuation modules 62 causes the associated drive pistons 100 to both push and pull the yoke structure 72 to extend and subsequently retract the blades 50, respectively, each valve assembly 96 may comprise an additional valve or a three-way valve (not shown) for changing the side of the drive vessel 98 to which the pressurized hydraulic fluid is conveyed, and from which hydraulic fluid may be bled concurrently.

Each drive unit 68 may include a pressure compensator 102 for equalizing the pressure in the drive vessel 98 with the downhole pressure of the wellbore. Each pressure compensator 102 may be in fluid communication with the associated drive vessel 98 via a fluid conduit 104 extending between the pressure compensator 102 and the reservoir 99. The pressure compensator 102 may include a compensator vessel 106 housing a compensator piston 108. The compensator vessel 106 may be a cylinder or any other type of vessel in communication with hydraulic fluid. A first side 110 of the compensator piston 108 may be exposed to the downhole pressure while a second, opposite side 112 of the compensator piston 108 may be exposed to the hydraulic fluid, which, in turn, is in fluid communication with the reservoir 99. In this manner, the compensator piston 108 may impart the relatively high downhole pressure to the reservoir 99, effectively equalizing pressure in the reservoir 99 and the drive vessel 98 with the downhole pressure. Such pressure equalization significantly reduces the power necessary to operate each electric motor 92 to cause an associated pump 94 to pressurize hydraulic fluid to move the drive piston 100 to cause movement of the blades 50 to an extended position.

The actuation modules 62 may include one or more sensors for ascertaining data regarding the blades 50, such as position indications of the blades 50 relative to the tool body 42 and extension force indications applied to the blades 50. The position and force indications of the blades 50 may be ascertained by indirect means. For example, the one or more sensors may include pressure sensors 113 located within the drive vessel 98. Pressure data from the pressure sensors 113 may be transmitted by the modem 87 of the associated electronics unit 74 to a bus processor 90, which may input the pressure data into an algorithm for deriving the extension force applied to the blades 50 and/or the position of the blades 50. The one or more sensors may also include sensors for determining relative position indications of the blades 50 by direct or indirect determination of position indications of other elements operatively coupled to one or more of the blades 50, such as position indications of the drive piston 100, the compensator piston 108, or any other component of the drive unit 68. The position indication may include a position, a distance, a starting point combined with a velocity and time, or any other direct or indirect position measurement, including pressure or force measurements. For instance, if position indications of the drive piston 100 are sensed by a sensor, it can be used to derive a position indication of the blades 50. For example, a linear variable differential transformer (LVDT) 114 may be disposed on the compensator piston 108 or the drive piston 100 and may be configured to indirectly measure the position of the blades 50 by directly measuring the linear displacement of the compensator piston 108 or the drive piston 100. The LVDT 114 may be located on the compensator piston 108 instead of on the drive piston 100 to avoid inputting unnecessary complexity and bulkiness to the drive piston 100 or the drive vessel 98 and to maintain smooth operation of the electric motor 92, the pump 94 and the valve assembly 96. However, it is to be appreciated that the LVDT 114 may optionally be located in the drive vessel 98 to measure the linear displacement of the drive piston 100. The position indication data and the force indication data may be transmitted from the modem 87 of each electronics unit 74 through the power and communication tool bus 82 to the BHA master controller 31 or the separate controller. The processor of the BHA master controller 31 or the separate controller may utilize the sensor data to ascertain the position of the blades 50 and the force applied to the blades 50 and may be used to modify or adjust the power and the command signals to the electronics units 74 accordingly.

In the embodiment shown in FIG. 7, the relationship between the position of the compensator pistons 108 and the drive pistons 100 (and thus the blades 50) may be ascertained by performing a reference, or calibration, stroke of the drive pistons 100 of the extension modules 62*a*, 62*b* from the fully retracted position to the fully extended position of the blades 50. The LVDTs may measure and transmit data to the bus processor 90 regarding the direction and magnitude of linear displacement of the compensator pistons 108 during the reference stroke. The direct correlation between the linear displacements of each drive piston 100 and each associated compensator piston 108 allows the processor 90 to calculate the ratio between the linear displacements of the drive pistons 100 and the compensator pistons 108, which ratio may be utilized by the processor 90 to subsequently estimate the position of the drive piston 100 (and, by correlation, of the blades 50) by interpreting the linear displacement data of the compensator piston 108 received from the LVDT 114 during subsequent strokes of the pistons 100, 108.

In other embodiments, the one or more sensors may include other types of sensors for ascertaining the position of the blades 50, including, by way of non-limiting example, an RPM sensor (not shown) for measuring the revolutions of the electric motor 92, a sensor for measuring the power draw (current) of electric motor 92, an internal linear displacement transducer (LDT) located within either the compensator vessel 106 or the drive vessel 98, and a Hall effect sensor located externally of either the compensator vessel 106 or the drive vessel 98 and configured to detect a magnetic element within the associated piston 100, 108. It is to be appreciated that use of any sensor suitable for measuring the position of the blades 50 is within the scope of the present disclosure. In additional embodiments, the one or more sensors may also include temperature sensors, vibration sensors, or any other sensor for ascertaining a condition of an associated actuation module 62.

Figure 8:
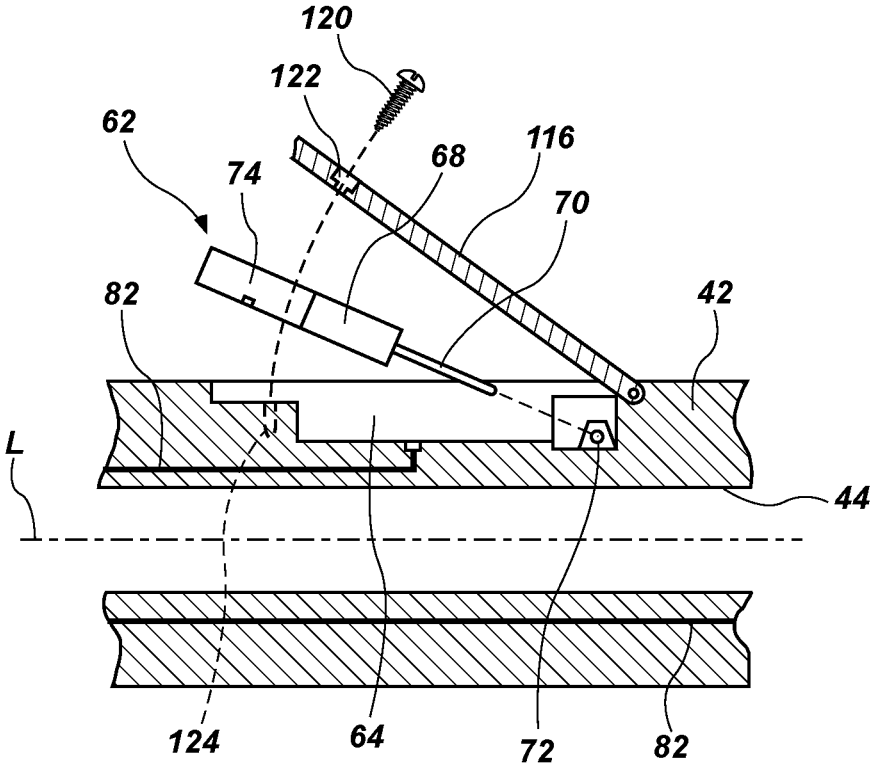
FIG. 8 is a partial cross-sectional view of a portion of a reamer tool body with a compartment for receiving an actuation module, according to an embodiment of the present disclosure.

Referring now to FIG. 8, an actuation module 62 is shown decoupled from the tool body 42. In the embodiment shown, the actuation module 62 is circumferentially offset from the blades 50 of the tool body 42; thus, no blades 50 are visible in the cross-sectional view provided. The tool body 42 may include a swinging hatch plate 116 rotatably connected thereto. The hatch plate 116 is shown in an open position providing access to a compartment 64 formed in the tool body 42, such as the module compartment 64 previously described in reference to FIG. 4. The module compartment 64 may be sized and configured to retain the actuation module 62 therein when the hatch plate 116 is fastened to the tool body 42 in the closed position (not shown). The actuation module 62 may be securely fastened to the tool body 42 within the module compartment 64 by mechanical fasteners, such as screws, bolts, brackets, locking mechanisms, clasps, interference fitting components, corresponding mounting and receiving formations on the actuation module 62 and on the tool body 42 within the compartment 64, or any other type of mechanical fastener. The distal end of the rod 70 may be coupled to the yoke structure 72 by screw, bolt, or any other suitable type of mechanical fastener. The hatch plate 116 may be fastened to the tool body 42 in the closed position via one or more screws 120 extending through an aperture 122 in the hatch plate 116 and into an associated threaded blind bore hole 124 in a portion of the tool body 42 configured to receive the screw 120. It is to be appreciated that any type of fastening component or structure for fastening the actuation module 62 to the tool body 42 in a repeatedly attachable and detachable manner is within the scope of embodiments of the present disclosure.

With continued reference to FIG. 8, to remove the actuation module 62 from the tool body 42 such as, for example, servicing or repair, a technician may remove the one or more screws 120 from the aperture 122 and associated blind bore hole 124 of the tool body 42 and lift open the free, swinging end of the hatch plate 116 to access the actuation module 62 located within the module compartment 64. The technician may then remove the fastener coupling the distal end of the rod 70 to the yoke structure 72 and unfasten the mechanical fastener retaining the actuation module 62 in the module compartment 64. Thereafter, the actuation module 62 may be removed from the compartment 64 of the tool body 42 as a single unit. The actuation module 62, as a self-contained unit, may maintain its inherent drive functionality while uncoupled with the tool body 42. The actuation module 62 may subsequently be reattached to the tool body 42 or, alternatively, a different but identical actuation module 62 may be attached to the tool body 42, in the manner previously described. In this manner, each actuation module 62 may be removed from the tool body 42, repaired or otherwise serviced, and recoupled to the tool body 42 at the drilling site and without requiring extensive repairs to the tool body 42. In much the same manner, actuation modules 62 may be removed from the tool body 42 and replaced with new or refurbished actuation modules on site.

The simplicity of the modular design allows the actuation modules 62 to be assembled in the tool body 42, removed from the tool body 42 and serviced and/or repaired by relatively untrained technicians, providing short turnaround times for assembly, disassembly, repair and reassembly of the tool 40. Additionally, the modular design allows the actuation modules 62 to be maintained, repaired, tested, or further managed at multiple service locations or at a single, centralized service location while being readily assignable to a tool body 42 in the field. The simplicity of the design is also enhanced by the fact that none of the components of the tool body 42 are required to interact with the drilling fluid flowing through the bore 44 of the tool body 42 in order to supply the actuation force to the blades 50, unlike prior art designs. Moreover, the design of the present embodiments does not require any moving component of the tool 40 to extend within the bore 44 or interact with drilling fluid flowing within the bore 44.

The simplicity of the modular design also allows the tool body 42 to be formed from a singular, unitary component, without requiring additional features or fluid seals within the bore 44. Further, the modular design also reduces the number of moving components carried by the tool body 42 absent the actuation modules 62. This allows the tool body 42 to have a more robust, compact design that enables a significantly shorter tool length compared to prior art reaming devices. The reduced length of the tool body 42 also allows greater flexibility in relation to where the tool 40 may be located in the bottom-hole assembly 10. The modular design also allows the modules 62 to be assembled and tested off-site and subsequently delivered to the final assembly location, or to be delivered for assembly at or near the drilling site.

Figure 9:
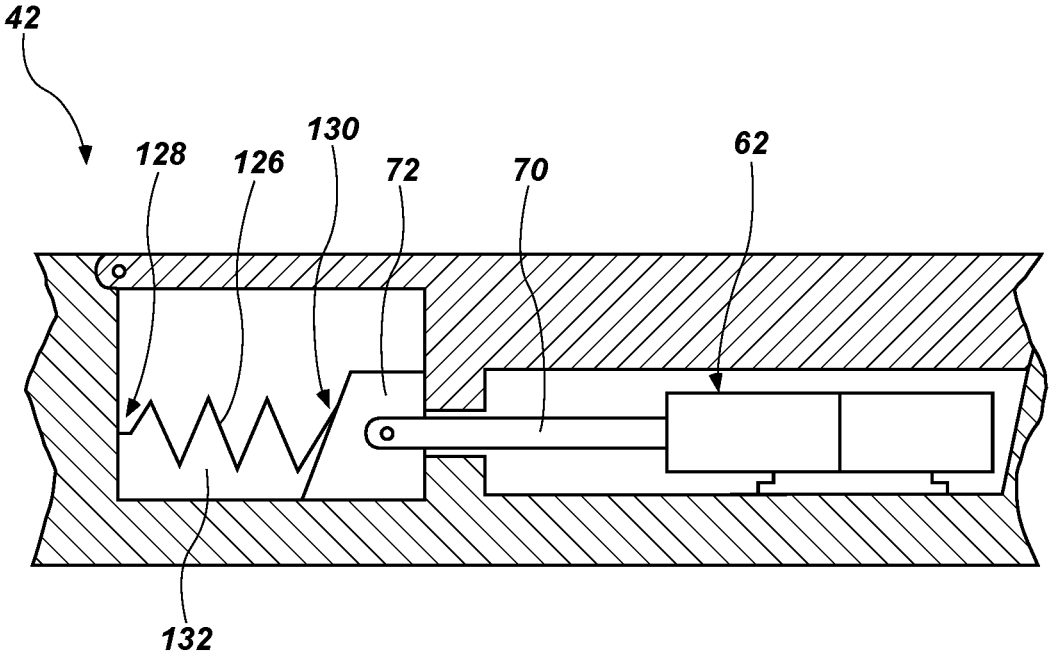
FIG. 9 illustrates a partial cross-sectional view of a reamer tool body having a return spring configured to bias one or more reamer blades toward a retracted position, according to an embodiment of the present disclosure.

Referring now to FIG. 9, an embodiment of the tool body 42 employing an automatic retraction element is shown. The automatic retraction element may comprise one or more return springs 126 coupled to the yoke structure 72 for biasing the blades 50 in the retracted position. In the embodiment of FIG. 9, the actuation module 62 depicted may be circumferentially offset from the associated blade 50 of the tool body 42; thus, no blades 50 are visible in FIG. 9. Additionally, the actuation module 62 is shown located longitudinally downward of the yoke structure 72 and configured to extend the reamer blades 50 by pushing longitudinally against the yoke structure 72. The one or more return springs 126 may comprise an extension spring having a first end 128 abutting a shoulder of the tool body 42 in a recessed chamber 132 in which at least a portion of the yoke structure 72 is located and a second, opposite end 130 abutting the yoke structure 72. It is to be appreciated that one or more return springs 126 may also be utilized to bias the blades 50 toward the retracted position in embodiments where the actuation modules 62 are located longitudinally above the blades 50, as well as in embodiments where the actuation modules 62 are circumferentially aligned with the blades 50.

It is to be appreciated that, in further embodiments, a mechanical drive unit may be utilized in lieu of the hydraulic drive units previously described. By way of non-limiting example, such a mechanical drive unit may include an electro-mechanical linear actuator, such as a spindle drive, a linear gear, a crank drive, or any other type of electro-mechanical drive for converting electrical power into linear actuation to translate the yoke structure 72 to extend and/or retract the blades 50.

While the foregoing description of the actuation modules 62 is mainly presented in the context of implementation within a reamer tool, it is to be understood that the actuation modules 62 may be used in tools comprising other actuatable elements, such as blades, stabilizer pads, valves, pistons, or packer sleeves. Such actuatable elements may be incorporated in tools including, but not limited to, reamers, expandable stabilizers, packer tools, or any other tool comprising actuatable elements. For instance, the actuation modules 62 may be used in the manner described above to actuate a valve or a packer sleeve in a downhole tool. The implementation and use of the actuation modules 62, as disclosed herein, in other tools different from reamers but still comprising actuatable elements, is within the scope of the present disclosure.

The various embodiments of the earth-boring tool and related methods previously described may include many other features not shown in the figures or described in relation thereto, as some aspects of the earth-boring tool and the related methods may have been omitted from the text and figures for clarity and ease of understanding. Therefore, it is to be understood that the earth-boring tool and the related methods may include many features or steps in addition to those shown in the figures and described in relation thereto. Furthermore, it is to be further understood that the earth-boring tool and the related methods may not contain all of the features and steps herein described.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventor.

What is claimed is:

1. A downhole tool, comprising:

a body defining a compartment therein, the compartment being radially decentralized within the body and comprising an angled surface at a longitudinal end thereof;

at least one self-contained module disposed within the compartment of the body and removably attached to the body, the at least one self-contained module comprising:

a drive unit; and at least one actuatable element operatively coupled to the drive unit, the drive unit configured to move the at least one actuatable element both axially and radially relative to a longitudinal axis of the downhole tool from a first position to a second position along the angled surface of the compartment.

2. The downhole tool of claim 1, wherein the at least one actuatable element is a reamer blade.

3. The downhole tool of claim 1, wherein the at least one actuatable element is a stabilizer pad.

4. The downhole tool of claim 1, wherein the at least one actuatable element is a packer sleeve.

5. The downhole tool of claim 1, wherein the downhole tool is one of an expandable reamer, an expandable stabilizer, or a packer tool.

6. The downhole tool of claim 1, wherein the self-container module further comprises an electronics unit disposed in the body, axially aligned with the drive unit, and configured to operate the drive unit.

7. The downhole tool of claim 6, wherein the drive unit comprises a hydraulic system, the hydraulic system comprising:

a motor in electrical communication with the electronics unit;

a drive vessel containing a reservoir of hydraulic fluid;

a hydraulic pump operatively coupled to the motor, the hydraulic pump in fluid communication with the reservoir of hydraulic fluid; and wherein the drive unit comprises a drive piston located within the drive vessel, the drive piston operatively coupled to the at least one actuatable element.

8. The downhole tool of claim 7, further comprising a valve assembly configured to control flow of hydraulic fluid from or to the reservoir of hydraulic fluid.

9. The downhole tool of claim 7, wherein the hydraulic system further comprises a pressure compensator comprising a compensator vessel in fluid communication with the hydraulic pump, the pressure compensator configured to at least partially equalize pressure within the compensator vessel with pressure of drilling fluid in a wellbore.

10. The downhole tool of claim 1, further comprising a sensor configured to sense one or more of a radial position or an axial position of the at least one actuatable element.

11. The downhole tool of claim 1, wherein the drive unit comprises a mechanical drive system, the mechanical drive system including an electro-mechanical linear actuator, the electro-mechanical linear actuator comprising one or more of a spindle drive, a linear gear, or a crank drive, the mechanical drive system for converting electrical power into motion.

12. A downhole tool, comprising:

a body defining a compartment therein, the compartment being radially decentralized within the body and comprising an angled surface at a longitudinal end thereof;

at least one self-contained module disposed within the compartment of the body and removably attached to the body, the at least one self-contained module comprising:

a drive unit comprising a drive element; and at least one actuatable element operatively coupled to the drive element, the drive unit configured to move the drive element to move the at least one actuatable element both axially and radially relative to a longitudinal axis of the downhole tool from a first position to a second position along the angled surface of the compartment, wherein a motion of the drive element is different from the motion of the at least one actuatable element.

13. The downhole tool of claim 12, wherein the self-container module further comprises an electronics unit disposed in the body, axially aligned with the drive unit, and configured to operate the drive unit.

14. The downhole tool of claim 13, wherein the at least one self-contained module comprises at least one sensor configured to sense one or more of a radial position or an axial position of the at least one actuatable element.

15. The downhole tool of claim 12, further comprising one or more biasing elements oriented to bias the at least one actuatable element toward at least one of the first position and the second position.

16. The downhole tool of claim 12, wherein the at least one self-contained module comprises:

a first self-contained module having a first drive unit configured to move the at least one actuatable element from the first position to the second position; and a second self-contained module having a second drive unit configured to move the at least one actuatable element from the second position to the first position.

17. The downhole tool of claim 12, wherein the downhole tool is one of an expandable reamer, an expandable stabilizer, or a packer tool.

18. A method of assembling a downhole tool, comprising removably attaching a self-contained module within a compartment of a body of the downhole tool the compartment comprising an angled surface at a longitudinal end thereof, the self-contained module comprising a drive unit and at least one actuatable element operatively coupled to the drive unit, the drive unit configured to move the at least one actuatable element both axially and radially relative to a longitudinal axis of the downhole tool from a first position to a second position along the angled surface of the compartment.

19. The method of claim 18, further comprising securing a sensor to the self-contained module, the sensor configured to sense one or more of a radial position or an axial position of the at least one actuatable element.

20. The method of claim 18, wherein the at least one actuatable element comprises a reamer blade.

* * * * *